US012733742B2

(12) United States Patent
Xu et al.

(10) Patent No.: US 12,733,742 B2
(45) Date of Patent: Sep. 15, 2026

(54) CONCEALED CUP HOLDER ASSEMBLY

(71) Applicant: MOTOMOTION CHINA CORPORATION, Changzhou (CN)

(72) Inventors: Mei Jun Xu, Jiujiang (CN); Guohong Li, Changzhou (CN); Rong Cai, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 130 days.

(21) Appl. No.: 18/827,766

(22) Filed: Sep. 8, 2024

(65) Prior Publication Data

US 2026/0069042 A1 Mar. 12, 2026

(51) Int. Cl.
*A47C 7/62* (2006.01)

(52) U.S. Cl.
CPC ..... *A47C 7/624* (2018.08)

(58) Field of Classification Search
CPC ..... A47C 7/624; A47C 7/622; B60N 3/102
See application file for complete search history.

(56) References Cited

U.S. PATENT DOCUMENTS

| | | | | |
|---|---|---|---|---|
| 5,106,153 | A * | 4/1992 | Durling | A47C 7/624 297/188.17 |
| 10,681,987 | B2 | 6/2020 | Liu et al. | |
| 11,490,736 | B1 * | 11/2022 | Liu | A47C 7/624 |
| D1,029,520 | S * | 6/2024 | Girdis | D6/336 |
| 2009/0152915 | A1 * | 6/2009 | Krasna | A47C 7/624 297/217.3 |
| 2020/0113337 | A1 * | 4/2020 | Liu | A47C 7/624 |

* cited by examiner

*Primary Examiner* — Joshua J Michener
*Assistant Examiner* — Nevena Aleksic
(74) *Attorney, Agent, or Firm* — LAW OFFICES OF STEVEN W. WEINRIEB

(57) ABSTRACT

A new and improved concealed cup holder assembly, for use upon a furniture piece having at least one side armrest, and an extendable/retractable footrest which extends laterally so as to cover a lower portion of the one side armrest, comprises a cup holder mounting plate, and a panel structure, having the cup holder mounting plate mounted thereon, pivotally mounted upon the one side armrest such that the cup holder mounting plate is movable between concealed and unconcealed positions, and having an inverted L-shaped configuration so as to form a part of the one side armrest and yet be disposed laterally outwardly of the extendable and retractable footrest such that movement of the extendable and retractable footrest between extended and retracted positions, and movement of the cup holder mounting plate between concealed and unconcealed positions, do not interfere with each other.

20 Claims, 12 Drawing Sheets

CONCEALED CUP HOLDER ASSEMBLY

FIELD OF THE INVENTION

The present invention relates generally to cup holder assemblies, and more particularly to a concealed cup holder assembly for use within powered chairs, love seats, sofas, and the like.

BACKGROUND OF THE INVENTION

Cup holder assemblies are often incorporated within powered chairs, love seats, sofas, and the like, so as to provide convenient access to a beverage for the occupant of the chair, love seat, or sofa when the occupant of the chair, love seat, or sofa is watching TV, reading a book, or enjoying some other kind of recreational activity. Cup holder assemblies are also often concealed within the arm, or other frame portion of the chair, love seat, or sofa, for aesthetic or cleanliness purposes. If they were not concealed, such cup holder assemblies would tend to accumulate dust or other debris. In addition, by concealing the cup holder assemblies, the structure of the cup holder assembly is effectively incorporated within the overall structure of the chair, love seat, or sofa, thereby presenting or providing the chair, love seat, or sofa with a smooth or clean aesthetic appearance. Examples of concealed cup holder assemblies for powered chairs, love seats, sofas, and the like, can be found within U.S. Pat. No. 10,681,987 which issued to Liu et al. on Jun. 16, 2020; and U.S. Pat. No. 11,490,736 which issued to Liu et al. on Nov. 8, 2922.

One type of popular conventional powered chair is one that effectively comprises T-cushions, as shown within FIGS. 10 and 11, wherein the chair 10 comprise leg rest and footrest sections 12,14 that effectively extend the entire width of the chair 10, that is, from one armrest 16 to the other armrest 16, so as to cover lower front portions of the armrests 16. Many people prefer this type of powered chair, with the T-cushions built into the overall structure of the chair, because a substantially wider leg rest/footrest is provided, thereby affording greater comfort to the occupant of the chair. However, it can readily be appreciated that incorporating concealed cup holders into the armrests of the chair becomes somewhat problematic due to the fact that the concealed cup holder assemblies cannot be incorporated into the front faces of the armrests, so as to then be movable from retracted to extended positions, because the T-cushions would effectively interfere with such movable concealed cup holder assemblies.

Accordingly, a need exists in the art for a new and improved cup holder assembly. Another need exists in the art for a new and improved cup holder assembly which can be readily incorporated within a chair, love seat, sofa, or the like. Still another need exists in the art for a new and improved cup holder assembly which can be readily incorporated within a chair, love seat, sofa, or the like, and wherein the cup holder assembly comprises a concealed cup holder assembly. Yet another need exists in the art for a new and improved cup holder assembly which can be readily incorporated within a chair, love seat, sofa, or the like, and wherein the cup holder assembly comprises a concealed cup holder assembly such that the cup holder assembly does not readily collect dust or debris. Still yet another need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, and wherein the cup holder assembly provides the chair, love seat, sofa, or the like, with an aesthetically pleasing appearance. Yet still another need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, and wherein the cup holder assembly can be incorporated within a chair, love seat, or sofa which has T-shaped cushions built into the furniture piece. A further need exists in the art for a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, wherein the cup holder assembly can be incorporated within a chair, love seat, or sofa which has T-shaped cushions built into the furniture piece, and yet concealed cup holder assemblies can be operatively incorporated into the overall frame structure of the furniture piece so as to be fully functional and yet accommodate the presence of the T-shaped cushions.

OVERALL OBJECTIVES OF THE INVENTION

An overall objective of the present invention is to provide a new and improved cup holder assembly. Another overall objective of the present invention is to provide a new and improved cup holder assembly which can be readily incorporated within a chair, love seat, sofa, or the like. Still another overall objective of the present invention is to provide a new and improved cup holder assembly which can be readily incorporated within a chair, love seat, sofa, or the like, and wherein the cup holder assembly comprises a concealed cup holder assembly. Yet another overall objective of the present invention is to provide a new and improved cup holder assembly which can be readily incorporated within a chair, love seat, sofa, or the like, and wherein the cup holder assembly comprises a concealed cup holder assembly such that the cup holder assembly does not readily collect dust or debris. Still yet another overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, and wherein the cup holder assembly provides the chair, love seat, sofa, or the like, with an aesthetically pleasing appearance. Yet still another overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, and wherein the cup holder assembly can be incorporated within a chair, love seat, or sofa which has T-shaped cushions built into the furniture piece. A further overall objective of the present invention is to provide a new and improved cup holder assembly which can be readily incorporated within a chair, love seat, sofa, or the like, wherein the cup holder assembly comprises a concealed cup holder assembly such that the cup holder assembly does not readily collect dust or debris, wherein the cup holder assembly provides the chair, love seat, sofa, or the like, with an aesthetically pleasing appearance, wherein the cup holder assembly can be incorporated within a chair, love seat, or sofa which has T-shaped cushions built into the furniture piece, and yet concealed cup holder assemblies can be operatively incorporated into the overall frame structure of the furniture piece so as to be fully functional and yet accommodate the presence of the T-shaped cushions.

SUMMARY OF THE INVENTION

The foregoing and other objectives of the present invention are achieved in accordance with the principles and teachings of the present invention through the provision of a powered chair wherein the cup holder assemblies are effectively mounted upon a pair of oppositely disposed panel assemblies which are incorporated within the oppositely disposed sides and armrests of the chair, and wherein each panel assembly effectively has an inverted L-shaped configuration, with oppositely disposed inwardly extending structure serving to mount the pair of cup holders. In this manner, the panel assemblies can effectively be built into the armrests of the chair, they can accommodate T-shaped cushions on the powered chair, they can provide the needed support for the cupholders, and the panel assemblies are nevertheless fully functional due to their inverted L-shaped configurations which effectively accommodate and do not interfere with the T-shaped cushions of the chair.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 11:
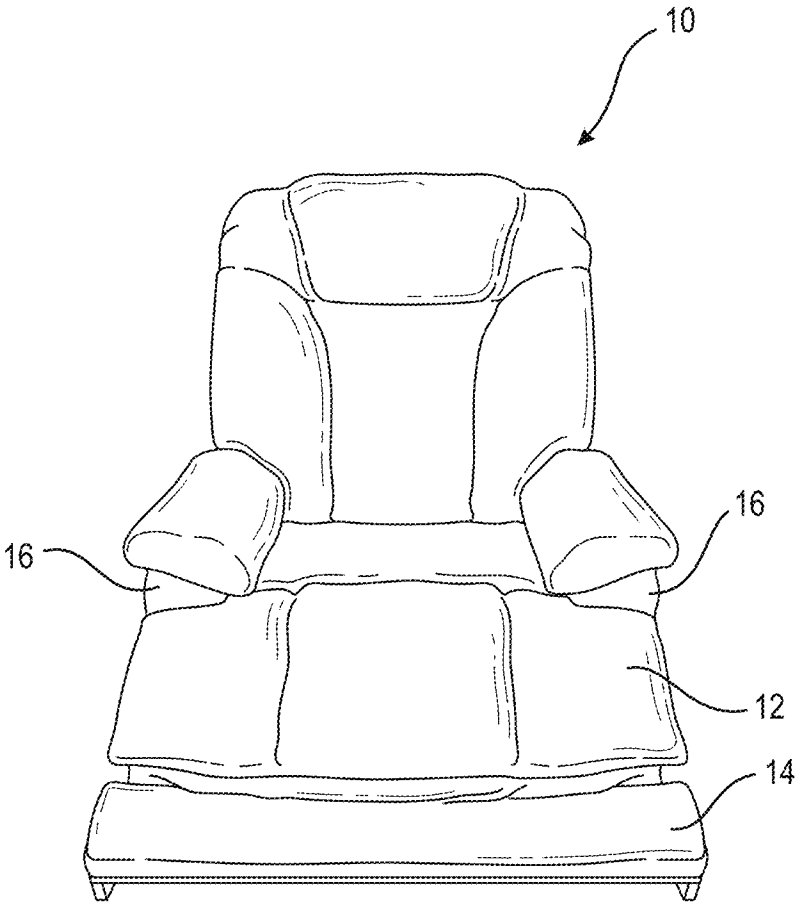
FIG. 11 is a front elevational view of the conventional, PRIOR ART powered chair, as illustrated within FIG. 11, wherein the leg and footrest portions of the chair are shown in their extended positions.
Figure 10:
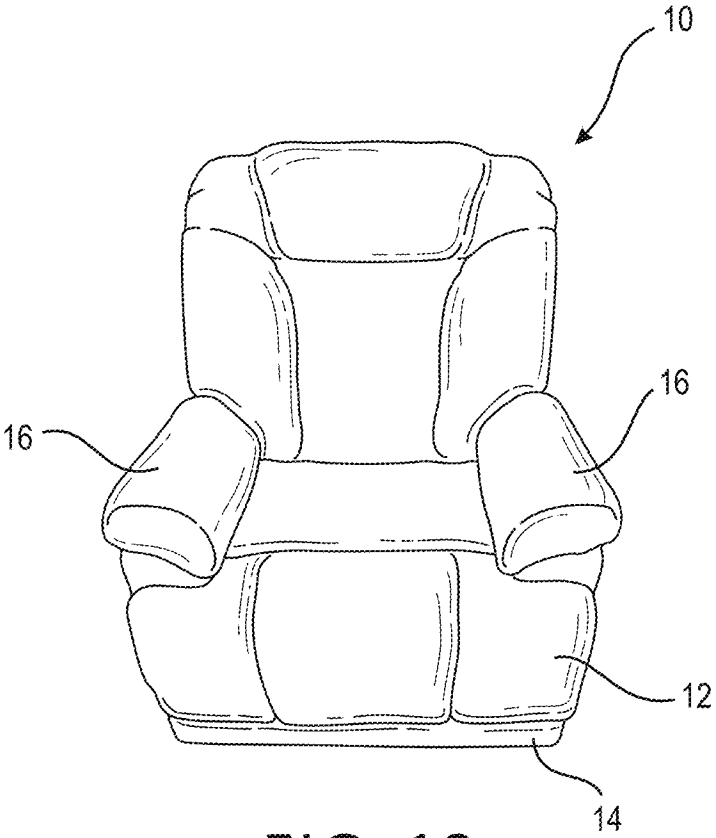
FIG. 10 is a front elevational view of a conventional, PRIOR ART powered chair having T-shaped cushions mounted thereon, wherein the cushions cover the leg and footrest portions of the chair, and the leg and footrest portions of the chair are shown in their retracted positions.

Referring now to the drawings, and more particularly to FIGS. 1-9, the concealed cup holder assembly is disclosed and is generally indicated by the reference character 100. It will be appreciated that the concealed cup holder assembly 100 of the present invention will effectively be disposed or accommodated within each one of the pair of oppositely disposed armrest structures of a chair 101, similar to those chairs disclosed within FIGS. 10 and 11, and accordingly, only one concealed cup holder assembly 100 will be described, it being further appreciated that the other concealed cup holder assembly 100 will effectively be a mirror image of the concealed cup holder assembly 100 being described. More particularly, the armrest structures 103 of the chair 101 can best be appreciated from FIGS. 1-9 wherein each armrest structure 103 comprises an outer panel 102, which can best be seen in FIGS. 6-9, and an oppositely disposed inner panel 104. In addition, it is seen that each cup holder assembly 100 comprises a movable inner panel 106, and an oppositely disposed movable outer panel 108, which can best be seen in FIGS. 8 and 9. Still further, an upper, transversely extending, horizontally oriented connecting plate 110, and a lower, transversely extending, vertically oriented connecting plate 112 are fixedly connected to the oppositely disposed interior surfaces of the movable inner panel 106 and the movable outer panel 108. In addition, a front panel 114 of the cup holder assembly 100 is fixedly connected to front end surface portions of both the inner and outer panels 106,108, so as to effectively form a front panel structure, while a cup holder mounting plate 116 is fixedly secured to upper end portions of both the inner and outer panels 106,108.

Figure 2:
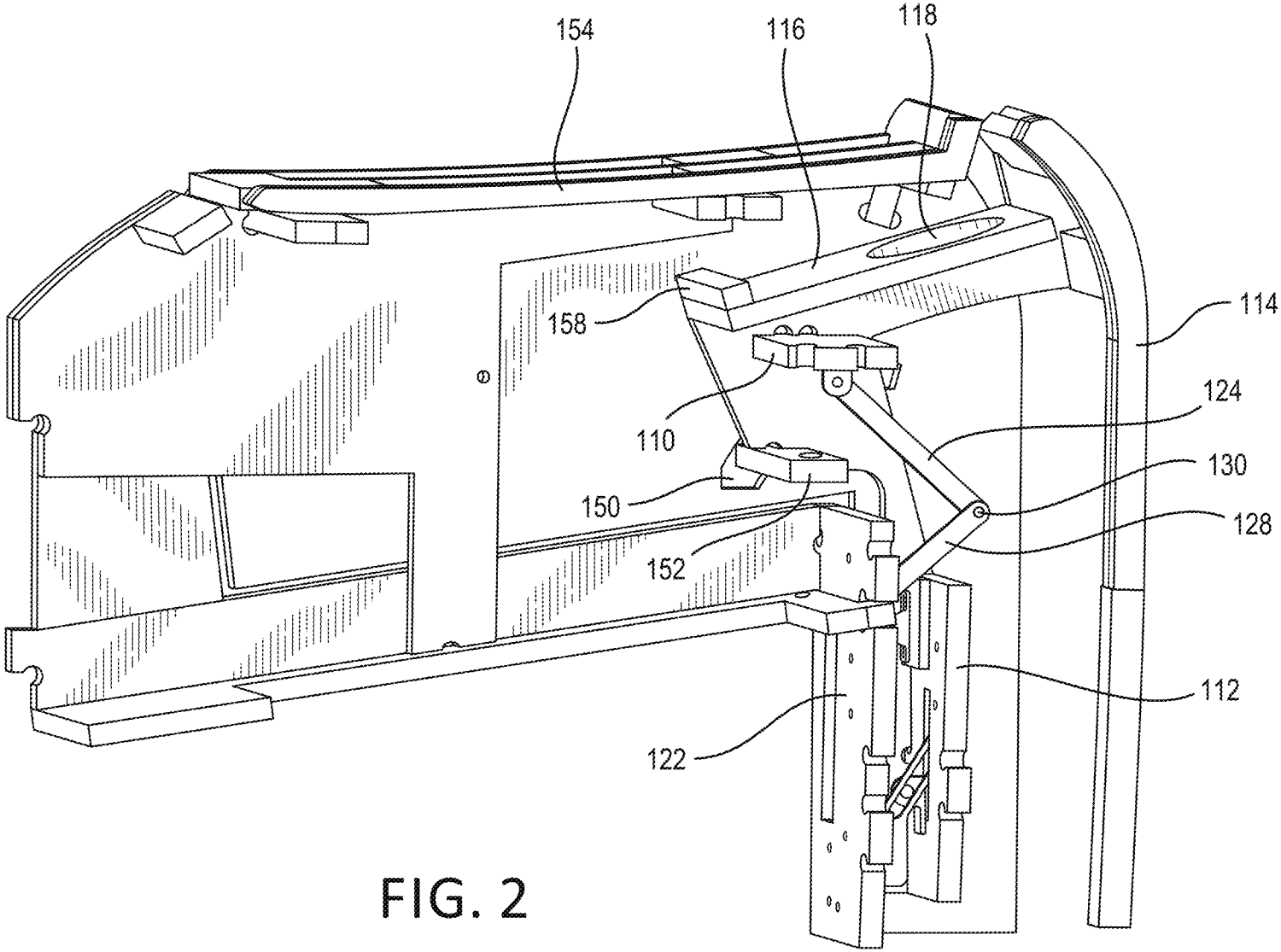
FIG. 2 is a perspective view of the concealed cup holder assembly, as shown in FIG. 1, wherein the concealed cup holder assembly is disclosed as being in its retracted or concealed position or state.
Figure 2A:
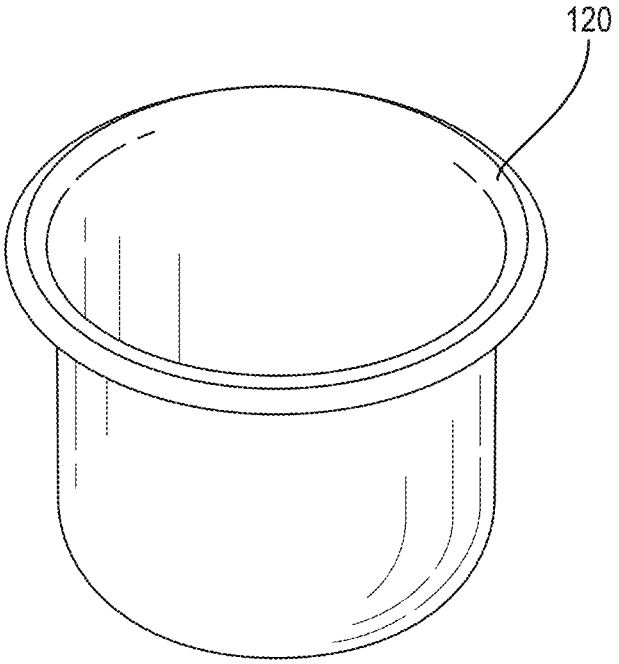
FIG. 2A is a perspective view of a cup holder that can be utilized within the cup holder assembly of the present invention.
Figure 3:
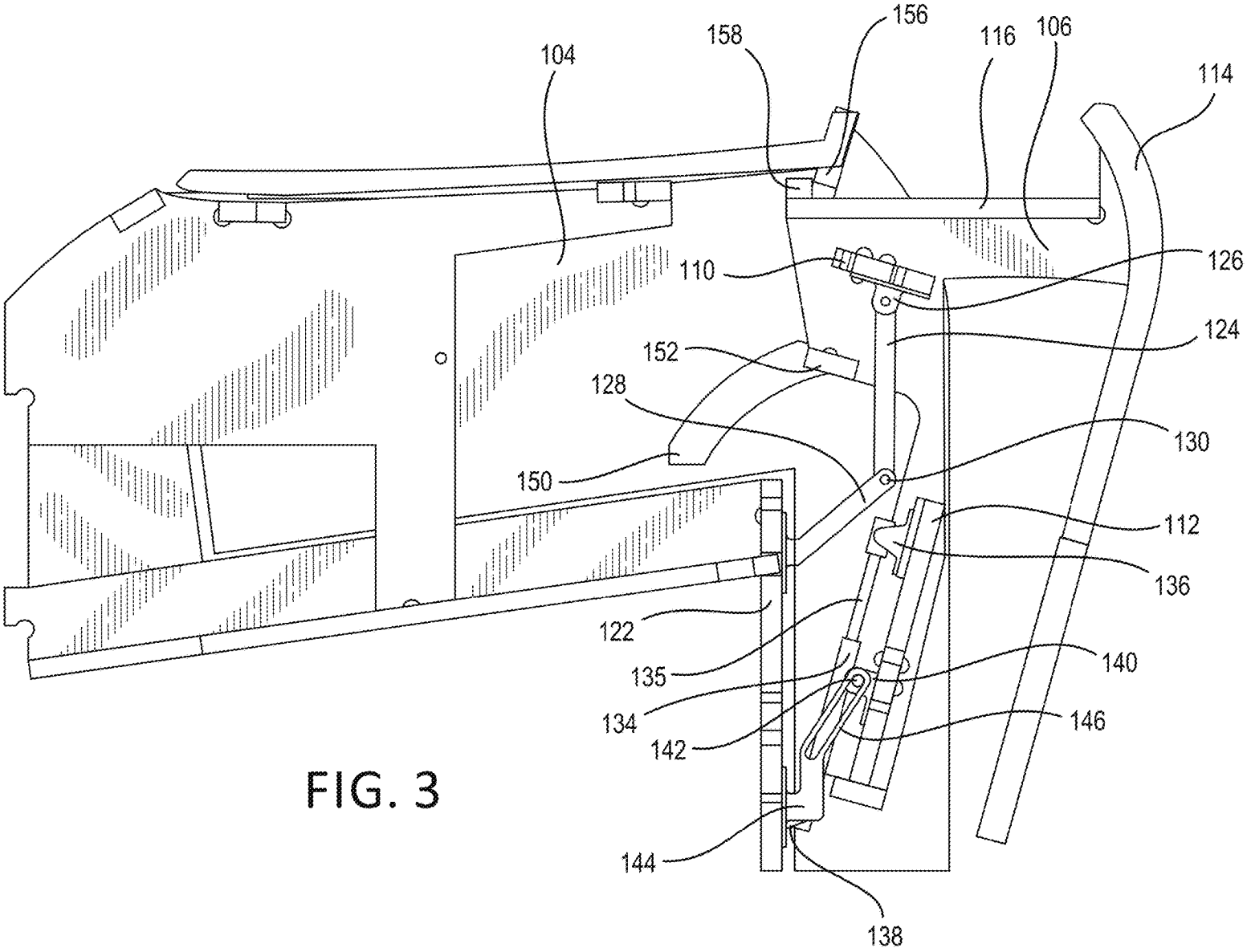
FIG. 3 is a cross-sectional view of the concealed cup holder assembly, as shown in FIG. 1, wherein the concealed cup holder assembly is disclosed as being in its extended or uncovered position or state.
Figure 4:
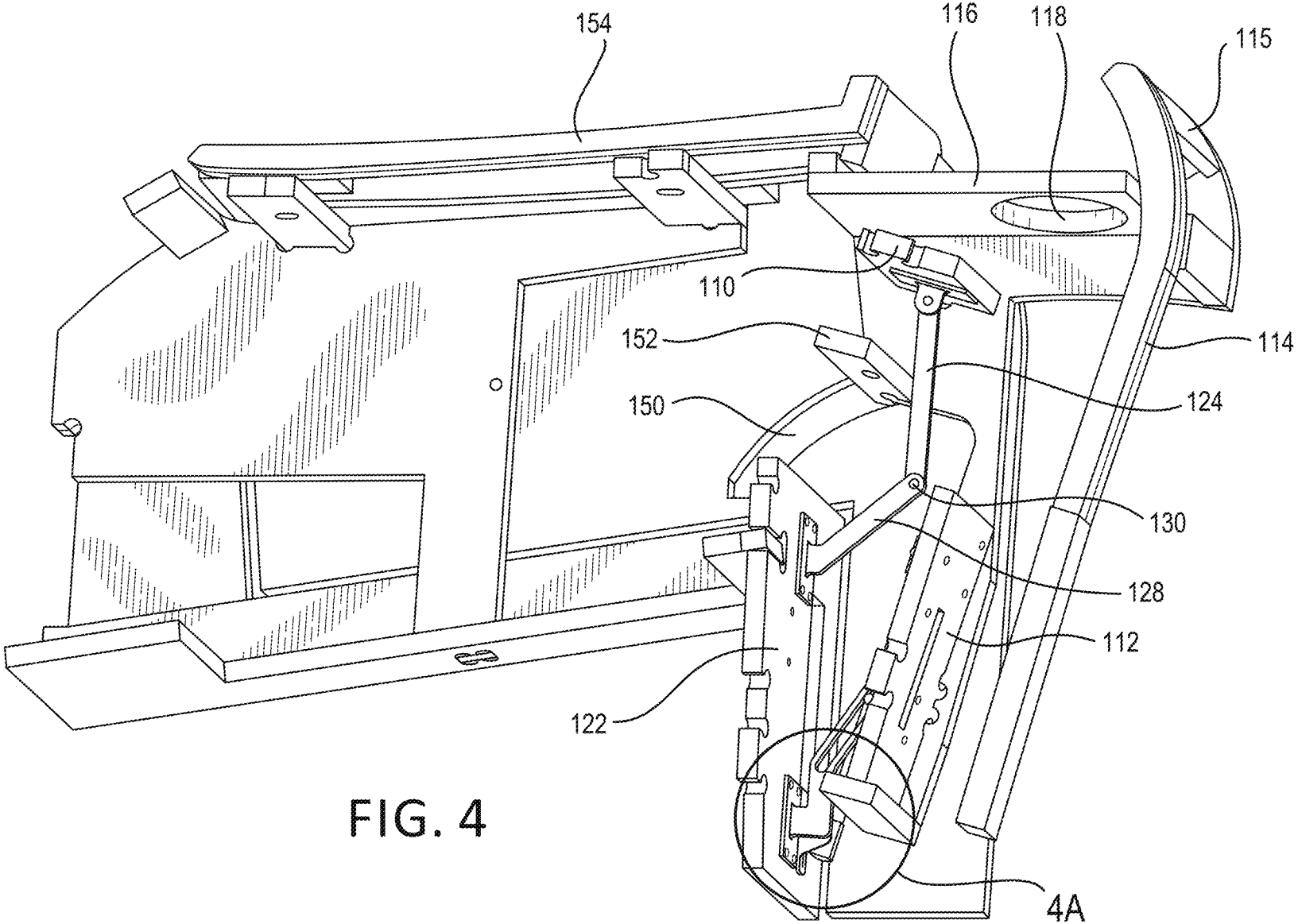
FIG. 4 is a perspective view of the concealed cup holder assembly, as shown in FIG. 1, wherein the concealed cup holder assembly is disclosed as being in its extended or uncovered position or state, and showing the cup holder mounting plate.
Figure 4A:
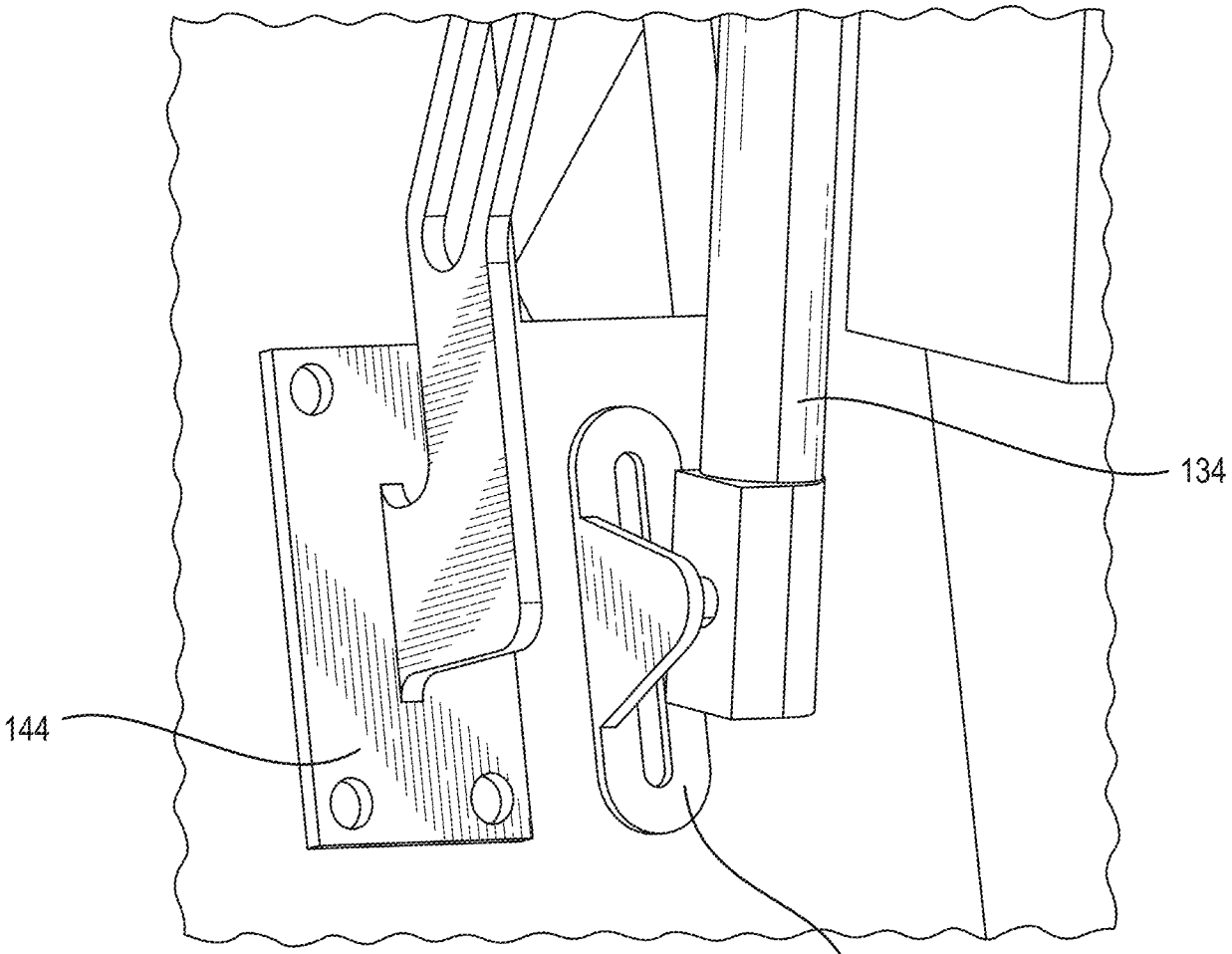
FIG. 4A is an enlarged detailed view of encircled region 4A in FIG. 4.
Figure 5:
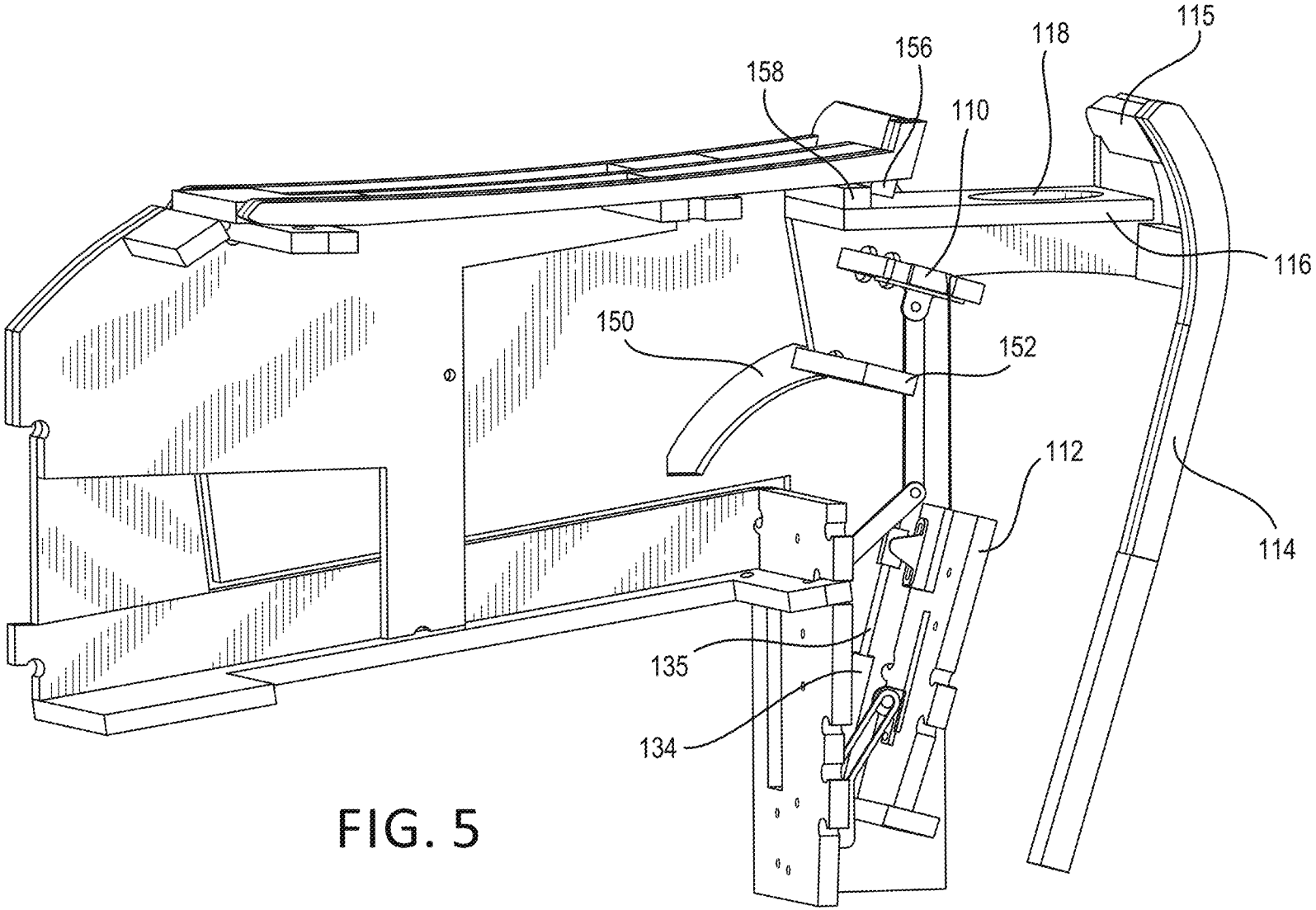
FIG. 5 is a perspective view of the concealed cup holder assembly, similar to that shown in FIG. 4, and showing the concealed cup holder assembly in its extended or uncovered position or state, and the cup holder mounting plate, from a different perspective.
Figure 6:
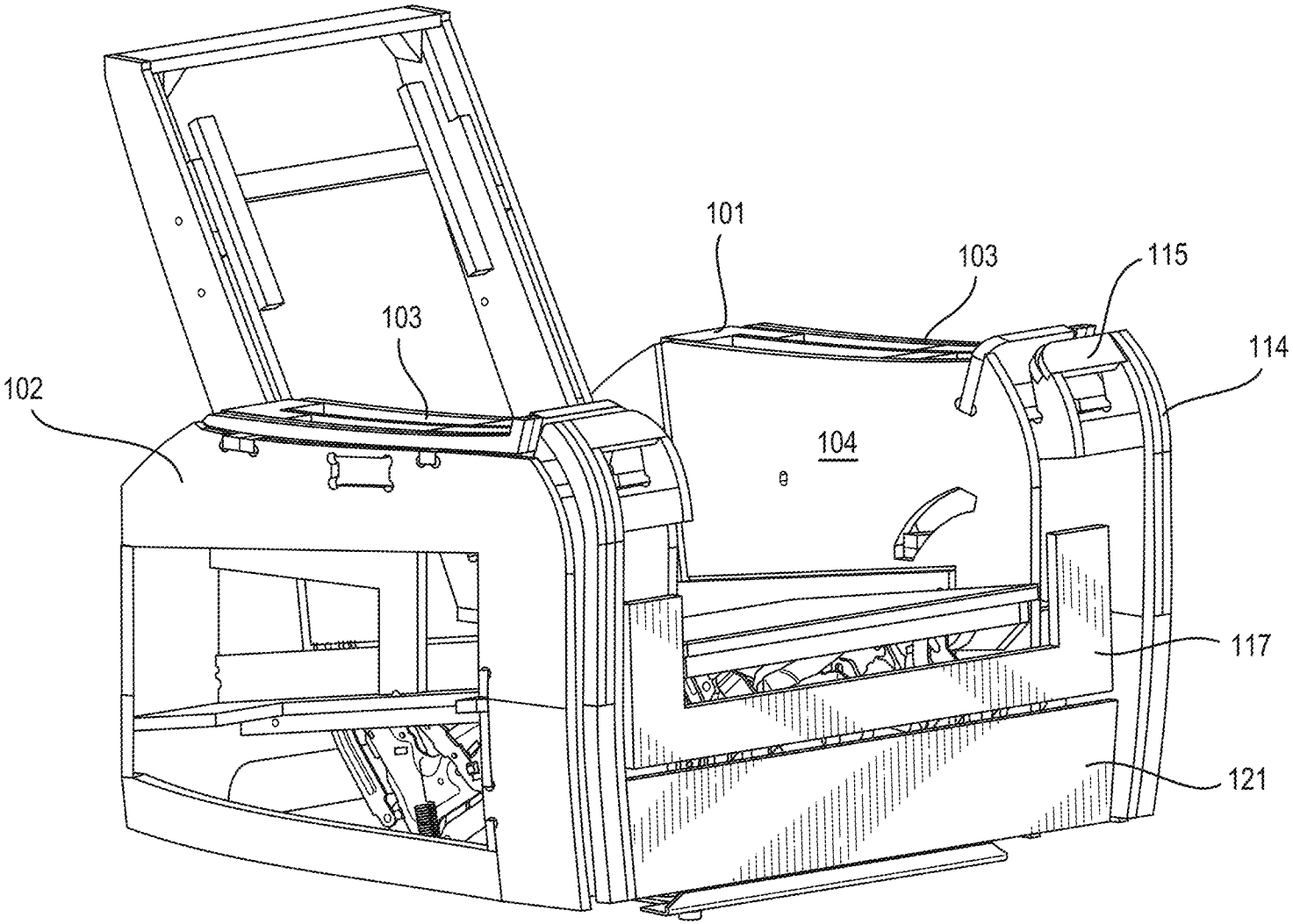
FIG. 6 is a perspective view of an armchair having the concealed cup holder assembly of the present invention incorporated therein, wherein the concealed cup holder assembly is disposed at its retracted and concealed position, and wherein the leg rest and footrest sections are also disposed at their retracted positions.
Figure 7:
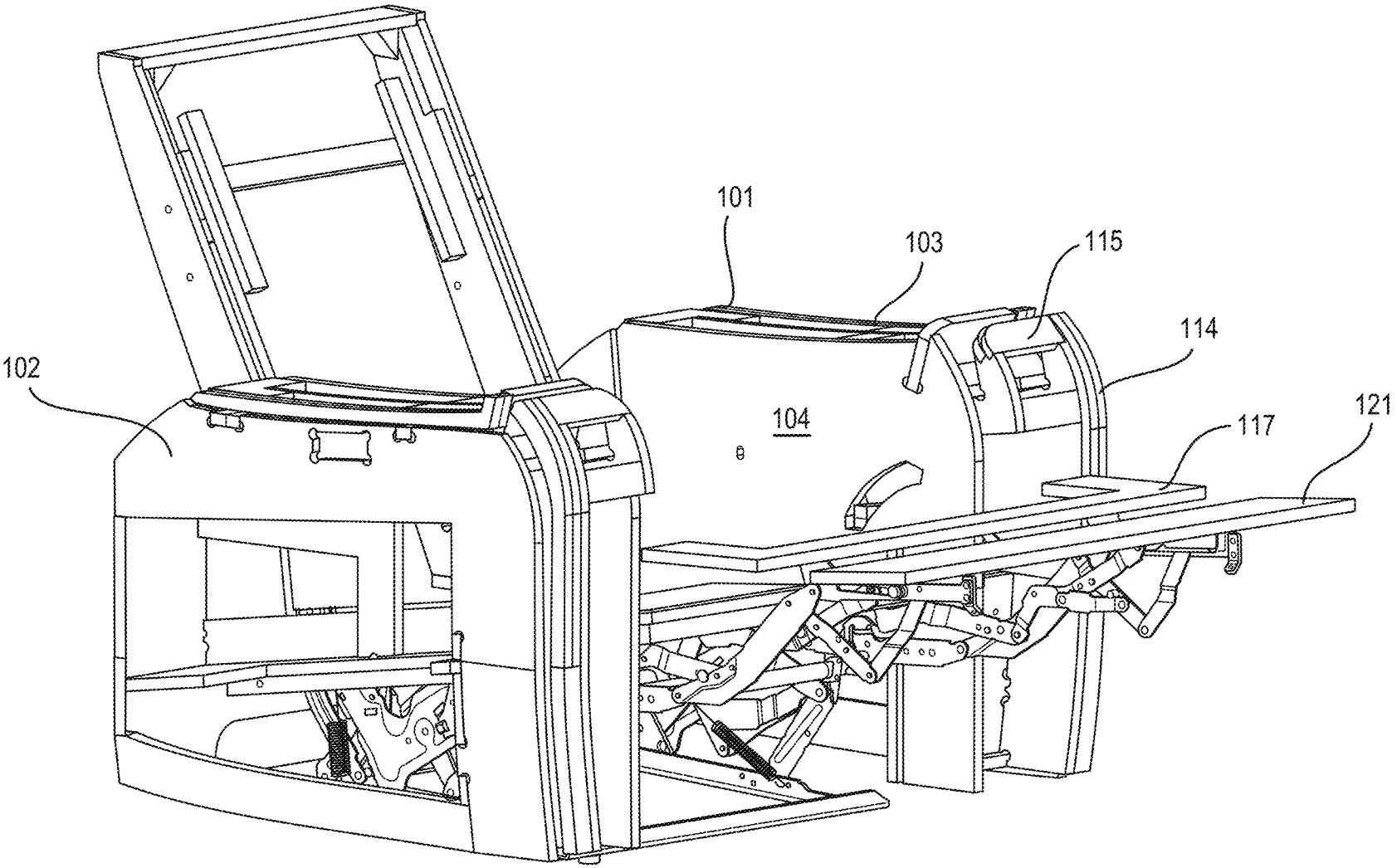
FIG. 7 is a perspective view of an armchair having the concealed cup holder assembly of the present invention incorporated therein, wherein the concealed cup holder assembly is disposed at its retracted and concealed position, and wherein the leg rest and footrest sections are disposed at their extended positions.
Figure 8:
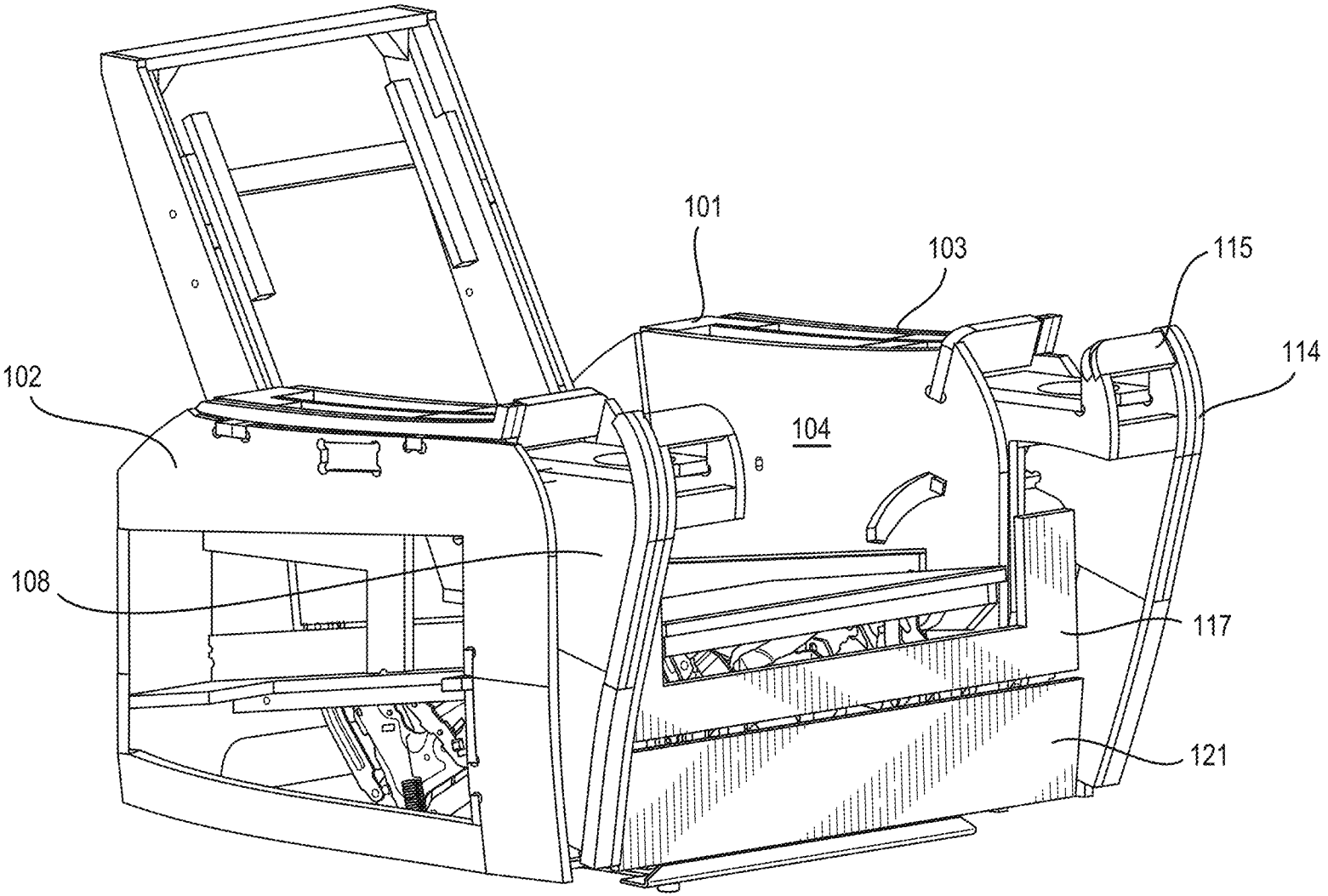
FIG. 8 is a perspective view of an armchair having the concealed cup holder assembly of the present invention incorporated therein, wherein the concealed cup holder assembly is disposed at its extended and uncovered position, and wherein the leg rest and footrest sections are disposed at their retracted positions.
Figure 9:
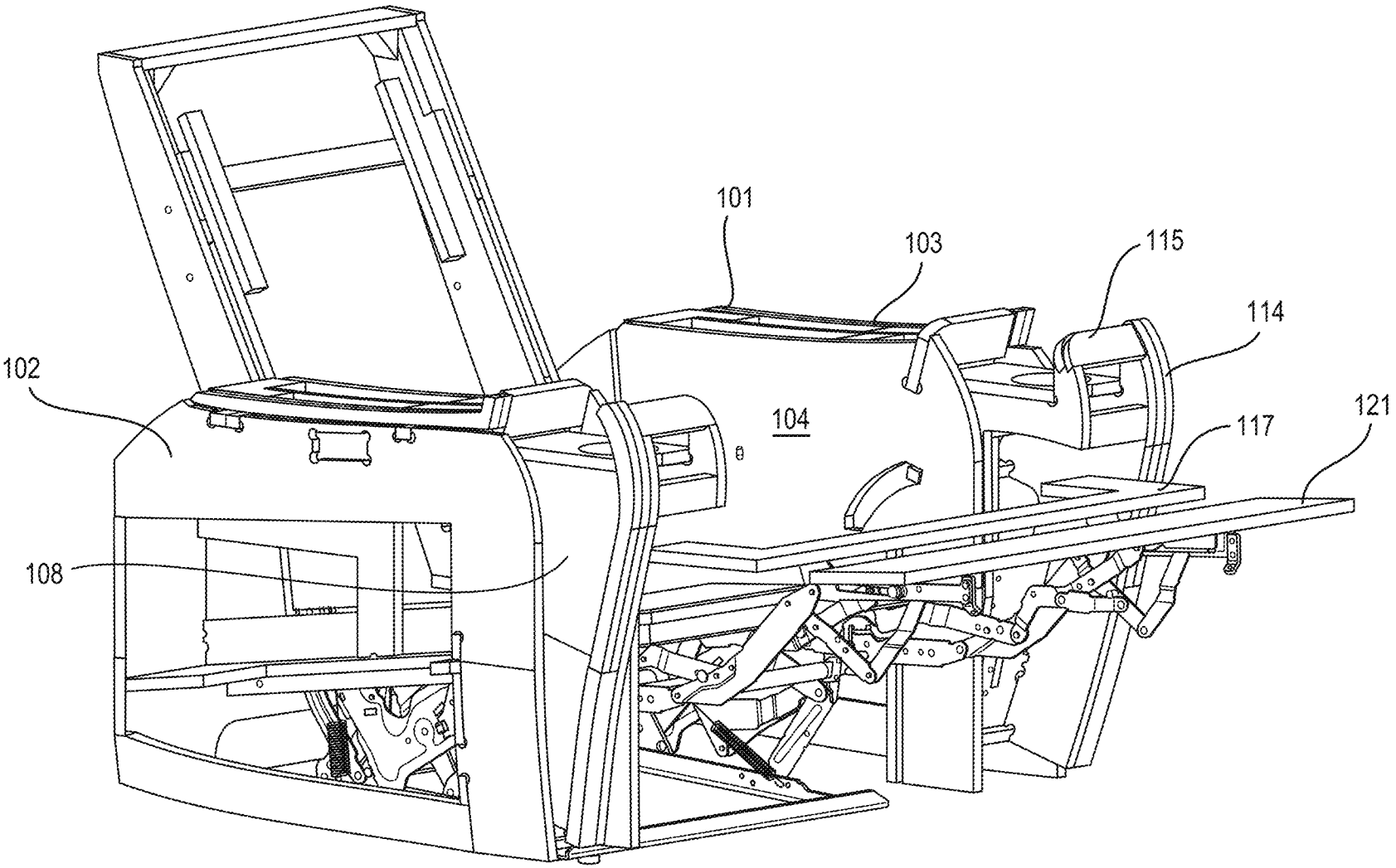
FIG. 9 is a perspective view of an armchair having the concealed cup holder assembly of the present invention incorporated therein, wherein the concealed cup holder assembly is disposed at its extended and uncovered position, and wherein the leg rest and footrest sections are also disposed at their extended positions.

As can best be seen from, for example, FIG. 2, the cup holder mounting plate 116 has an aperture or hole 118 defined therein whereby a cup holder 120, such as the one illustrated within FIG. 2A, can be inserted and mounted therein. Still further, as can best be seen and appreciated from FIGS. 4 and 6-9, and in accordance with the unique features of the present invention, it is seen that the front panel structure 114 is such that the front panel 114 of each cup holder assembly 100 includes or comprises a laterally or transversely inwardly extending support structure or framework 115 to which the cup holder mounting plate 116 is fixedly attached. As can additionally be seen and appreciated from FIGS. 4 and 6-9, the front panel structure 114 is effectively has an inverted L-shaped configuration. Accordingly, it can be further seen and appreciated from FIGS. 4 and 6-9 that this unique, inverted L-shaped structure is disposed laterally outside or outwardly from the leg rest section 117 of the chair 101, as well as the footrest section 121 of the chair 101, so as not to interfere with the extension or retraction of the leg rest and footrest sections 117,121 of the chair 101. In addition, it is further seen and appreciated that the laterally or transversely inwardly extending support structure or framework 115 not only supports or mounts the cup holder mounting plate 116 for the cup holder 120, but, in addition, is effectively an integral part of the armrest structures 103 of the chair 101.

To complete the armrest structure 103, a central, transversely extending panel 122 is likewise fixedly connected to the oppositely disposed interior surfaces of the inner and outer panels 102,104. Still further, a first link 124 is pivotally connected at its upper end to an undersurface portion of the upper, transversely extending, horizontally oriented connecting plate 110 by means of a suitable clevis mounting 126, while the second opposite end of the first link 124 is pivotally connected to a first end portion of a second link 128 as at 130, the second end of the second link 128 being fixedly mounted upon an upper end portion of the central, transversely extending panel 122 by means of a suitable mounting bracket 132. A pneumatic cylinder 134, having a telescopic rod 135, is pivotally connected at its upper end to a suitable mounting bracket 136 which is fixedly mounted upon an upper region of the rear surface of the lower, transversely extending, vertically oriented connecting plate 112, while the lower end portion of the pneumatic cylinder 134 is pivotally connected to a lower end portion of the central, transversely extending panel 122 by means of a suitable mounting bracket 138. In addition, it is also seen that a male limit pin mount 140, having a limit pin 142 mounted thereon, is adapted to be mounted upon a rear surface portion of the lower, transversely extending, vertically oriented connecting plate 112, while a female mount 144, having a slot 146 defined therein for accommodating the limit pin 142 of the male limit pin mount 140, is fixedly mounted upon a lower front surface portion of the central, transversely extending panel 122 by means of a suitable mounting bracket 148. Continuing further, it is seen that the inner panel 104 of the armrest structure is provided with an arcuate cam slot 150, and a cam follower 152, in the form of a substantially horizontally oriented block, is fixedly mounted upon and connected to the inner and outer panels 106,108 of the cupholder assembly 100 such that one end of the cam follower 152 projects into the arcuate cam slot 150. Lastly, it is seen that the armrest structure 103 comprises a fixed upper plate 154 upon which there is disposed a first limit block 156, while a second limit block 158 is mounted upon the cup holder mounting plate 116.

Figure 1:
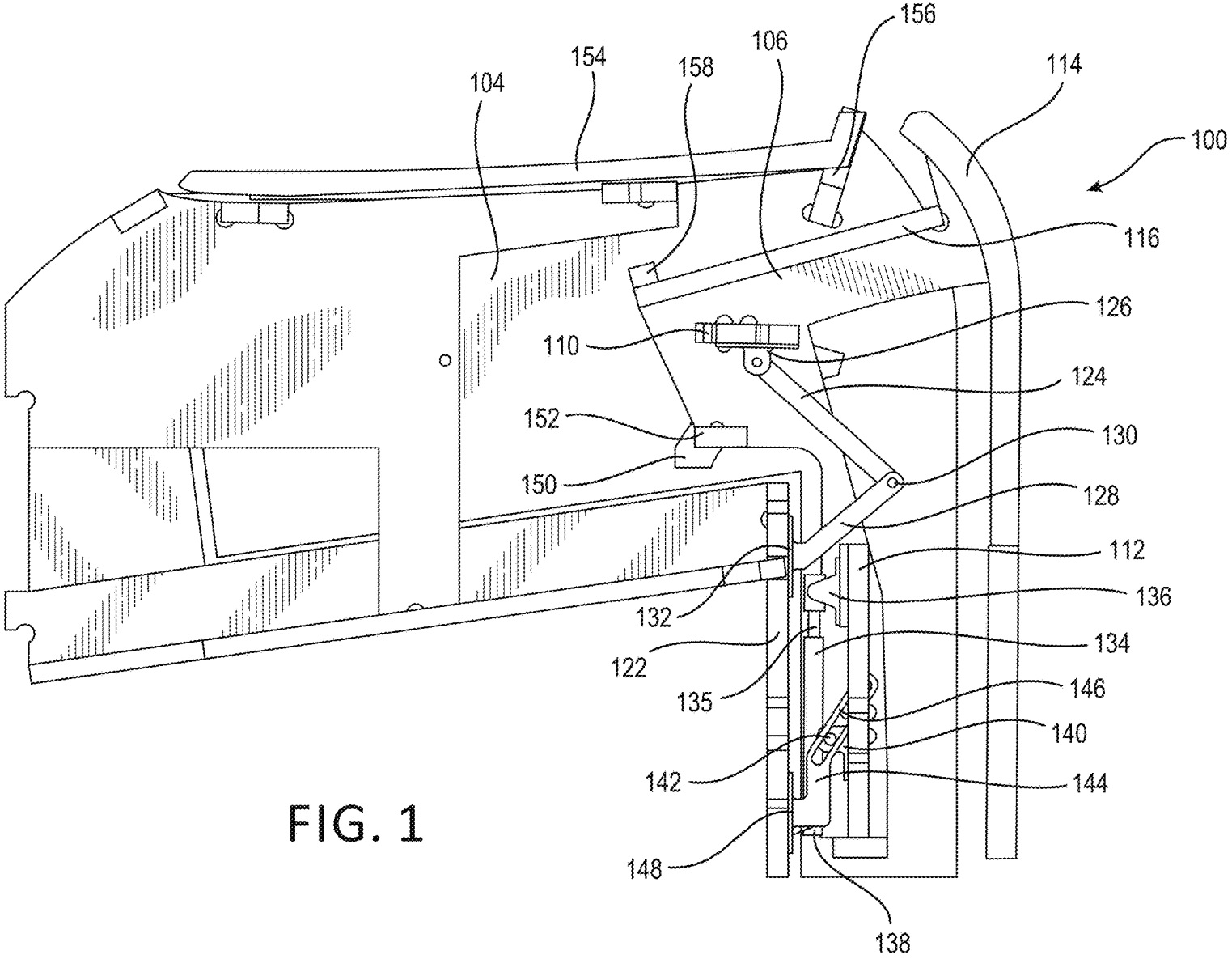
FIG. 1 is a cross-sectional view of a new and improved concealed cup holder assembly, as constructed in accordance with the principles and teachings of the present invention, and wherein the concealed cup holder assembly is disclosed as being in its retracted or concealed position or state.

In operation, when the cup holder assembly 100 is disposed at its closed position such that the front panel structure 114 is disposed at its retracted position and the cup holder mounting plate 116 is disposed at it concealed position, as illustrated within FIG. 1, the cup holder mounting plate 116 is disposed at a predetermined upwardly inclined angle as one proceeds from back to front, while the lower, transversely extending, vertically oriented connecting plate 112 and the front panel of the front panel structure 114 of the cup holder assembly 100 are disposed parallel to the central, transversely extending panel 122. When a forwardly directed pulling force is exerted upon the front panel structure 114 of the cup holder assembly 100 so as to move the front panel structure 114 from its closed or retracted position to its extended or open position, and thereby move the cup holder mounting plate 116 from its concealed position to its unconcealed position, the entire cup holder assembly 100, that is, the inner and outer side panels 106,108 will pivot clockwise as viewed within FIG. 1, as do the upper, transversely extending, horizontally oriented connecting plate 110 and the lower, transversely extending, vertically oriented connecting plate 112. Therefore, the first link 124 will pivot around its pivotal connection 130, and the limit pin 142 will move upwardly within the limit pin slots 146. In addition, the telescopic rod 135 of the pneumatic cylinder 134 will be extended and the pneumatic cylinder 134 will likewise pivot in the clockwise direction so as to facilitate the smooth movement of the cup holder assembly 100 from its retracted position or state to its extended position or state. During this movement cycle, it is noted that the cam follower 152 will move within the arcuately configured cam slot 150 so as to effectively impart an upward and forward movement to the cup holder assembly 100, and in addition, the second limit block 158 will encounter the first limit block 156 such that the extent to which the cup holder assembly 100 can be extended, and moved to its fully open position, is limited to a predetermined degree. It is lastly noted that, as illustrated within FIGS. 8 and 9, when the cup holders assemblies 100,100 are fully extended such that the cup holder mounting plates 116,116 are disposed at their unconcealed positions, each cup holder mounting plate 116 is disposed or oriented horizontally such that the cup holder 120 will be oriented vertically as it is supported within the cup holder mounting plate 116.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent, is:

1. A concealed cup holder assembly, for use upon a furniture piece having at least one side armrest, and an extendable/retractable footrest which extends laterally so as to cover a lower portion of said at least one side armrest, comprising:

a cup holder mounting plate; and a panel structure, having said cup holder mounting plate mounted thereon, pivotally mounted upon said at least one side armrest such that said cup holder mounting plate is movable between concealed and unconcealed positions, and having an inverted L-shaped configuration such that a vertically oriented leg of said L-shaped panel structure forms a part of said at least one side armrest and yet is disposed laterally outwardly of said extendable and retractable footrest, while a horizontally oriented, laterally inwardly extending portion of said L-shaped panel structure vertically overlaps a part of said extendable and retractable footrest such that movement of said extendable and retractable footrest between extended and retracted positions, and movement of said cup holder mounting plate between said concealed and unconcealed positions, do not interfere with each other.

2. The concealed cup holder assembly as set forth in claim 1, wherein:

said panel structure is interposed between a pair of oppositely disposed side panel members of said at least one side armrest.

3. The concealed cup holder assembly as set forth in claim 1, further comprising:

a cam slot defined within one of said pair of oppositely disposed side panel members of said at least one side armrest; and a cam follower mounted upon said panel structure such that as said panel structure, and said cup holder mounting plate mounted thereon, are moved between said retracted and extended positions, and said concealed and unconcealed positions, respectively, said cam follower will follow said cam slot and thereby guide the movement of said panel structure, and said cup holder mounting plate mounted thereon, between said retracted and extended positions, and said concealed and unconcealed positions, respectively.

4. The concealed cup holder assembly as set forth in claim 3, wherein:

said cam slot has an arcuate configuration such that when said cam follower follows said arcuate cam slot, said panel structure, and said cup holder mounting plate mounted thereon, are moved between said retracted and extended positions, and said concealed and unconcealed positions, respectively, along an arcuate path such that said panel structure, and said cup holder mounting plate mounted thereon, will undergo upward and forward movement as said panel structure, and said cup holder mounting plate mounted thereon, move between said retracted and extended positions, and said concealed and unconcealed positions, respectively.

5. The concealed cup holder assembly as set forth in claim 1, further comprising:

a first limit stop fixedly mounted upon said at least one side armrest; and a second limit stop fixedly mounted upon said panel structure such that when said panel structure, and said cup holder mounting plate mounted thereon, are moved between said retracted and extended positions, and said concealed and unconcealed positions, respectively, movement of said panel structure, and said cup holder mounting plate mounted thereon, between said retracted and extended positions, and said concealed and unconcealed positions, respectively, will be limited to a predetermined extent.

6. The concealed cup holder assembly as set forth in claim 4, further comprising:

an extensible/retractable linkage system defined between said at least one side armrest and said panel structure for facilitating said upward and forward movement of said panel structure, and said cup holder mounting plate mounted thereon, as said panel structure, and said cup holder mounting plate mounted thereon, move between said retracted and extended positions, and said concealed and unconcealed positions, respectively.

7. The concealed cup holder assembly as set forth in claim 4, further comprising:

an actuator operatively connected to said at least one side armrest and said panel structure for facilitating said upward and forward movement of said panel structure, and said cup holder mounting plate mounted thereon, as said panel structure, and said cup holder mounting plate mounted thereon, move between said retracted and extended positions, and said concealed and unconcealed positions, respectively.

8. The concealed cup holder assembly as set forth in claim 7, wherein:

said actuator is pivotally mounted upon said at least one side armrest.

9. The concealed cup holder assembly as set forth in claim 7, wherein:

said actuator comprises a pneumatic cylinder.

10. The concealed cup holder assembly as set forth in claim 9, wherein:

said pneumatic cylinder comprises a telescopic rod which is extended when said panel structure, and said cup holder mounting plate mounted thereon, is moved from said retracted position to said extended position, and said cup holder mounting plate is moved from said concealed position to said unconcealed position, and is retracted when said panel structure, and said cup holder mounting plate mounted thereon, is moved from said extended position to said retracted position, and said cup holder mounting plate is moved from said unconcealed position to said concealed position.

11. A furniture piece having at least one side armrest, an extendable/retractable footrest which extends laterally so as to cover a lower portion of said at least one side armrest, and a concealed cup holder assembly, comprising:

a cup holder mounting plate; and a panel structure, having said cup holder mounting plate mounted thereon, pivotally mounted upon said at least one side armrest such that said cup holder mounting plate is movable between concealed and unconcealed positions, and having an inverted L-shaped configuration such that a vertically oriented leg of said L-shaped panel structure forms a part of said at least one side armrest and yet is disposed laterally outwardly of said extendable and retractable footrest, while a horizontally oriented, laterally inwardly extending portion of said L-shaped panel structure vertically overlaps a part of said extendable and retractable footrest such that movement of said extendable and retractable footrest between extended and retracted positions, and movement of said cup holder mounting plate between said concealed and unconcealed positions, do not interfere with each other.

12. The furniture piece as set forth in claim 11, wherein:

said panel structure is interposed between a pair of oppositely disposed side panel members of said at least one side armrest.

13. The furniture piece as set forth in claim 11, further comprising:

a cam slot defined within one of said pair of oppositely disposed side panel members of said at least one side armrest; and a cam follower mounted upon said panel structure such that as said panel structure, and said cup holder mounting plate mounted thereon, are moved between said retracted and extended positions, and said concealed and unconcealed positions, respectively, said cam follower will follow said cam slot and thereby guide the movement of said panel structure, and said cup holder mounting plate mounted thereon, between said retracted and extended positions, and said concealed and unconcealed positions, respectively.

14. The furniture piece as set forth in claim 13, wherein:

said cam slot has an arcuate configuration such that when said cam follower follows said arcuate cam slot, said panel structure, and said cup holder mounting plate mounted thereon, are moved between said retracted and extended positions, and said concealed and unconcealed positions, respectively, along an arcuate path such that said panel structure, and said cup holder mounting plate mounted thereon, will undergo upward and forward movement as said panel structure, and said cup holder mounting plate mounted thereon, move between said retracted and extended positions, and said concealed and unconcealed positions, respectively.

15. The furniture piece as set forth in claim 11, further comprising:

a first limit stop fixedly mounted upon said at least one side armrest; and a second limit stop fixedly mounted upon said panel structure such that when said panel structure, and said cup holder mounting plate mounted thereon, are moved between said retracted and extended positions, and said concealed and unconcealed positions, respectively, movement of said panel structure, and said cup holder mounting plate mounted thereon, between said retracted and extended positions, and said concealed and unconcealed positions, respectively, will be limited to a predetermined extent.

16. The furniture piece as set forth in claim 14, further comprising:

an extensible/retractable linkage system defined between said at least one side armrest and said panel structure for facilitating said upward and forward movement of said panel structure, and said cup holder mounting plate mounted thereon, as said panel structure, and said cup holder mounting plate mounted thereon, move between said retracted and extended positions, and said concealed and unconcealed positions, respectively.

17. The furniture piece as set forth in claim 14, further comprising:

an actuator operatively connected to said at least one side armrest and said panel structure for facilitating said upward and forward movement of said panel structure, and said cup holder mounting plate mounted thereon, as said panel structure, and said cup holder mounting plate mounted thereon, move between said retracted and extended positions, and said concealed and unconcealed positions, respectively.

18. The furniture piece as set forth in claim 17, wherein:

said actuator is pivotally mounted upon said at least one side armrest.

19. The furniture piece as set forth in claim 17, wherein:

said actuator comprises a pneumatic cylinder.

20. The concealed cup holder assembly as set forth in claim 19, wherein:

said pneumatic cylinder comprises a telescopic rod which is extended when said panel structure, and said cup holder mounting plate mounted thereon, is moved from said retracted position to said extended position, and said cup holder mounting plate is moved from said concealed position to said unconcealed position, and is retracted when said panel structure, and said cup holder mounting plate mounted thereon, is moved from said extended position to said retracted position, and said cup holder mounting plate is moved from said unconcealed position to said concealed position.

* * * * *